US007631648B2

(12) United States Patent
Kirby

(10) Patent No.: US 7,631,648 B2
(45) Date of Patent: Dec. 15, 2009

(54) HAIR EXTENSION CLIP

(76) Inventor: Adrian Kirby, 7222 LaSobrina, Dallas, TX (US) 75248

( * ) Notice: Subject to any disclaimer, the term of this patent is extended or adjusted under 35 U.S.C. 154(b) by 425 days.

(21) Appl. No.: 11/726,635

(22) Filed: Mar. 23, 2007

(65) Prior Publication Data

US 2008/0230085 A1 Sep. 25, 2008

(51) Int. Cl.
*A45D 8/00* (2006.01)
*A45D 8/20* (2006.01)

(52) U.S. Cl. ..... 132/276; 132/277

(58) Field of Classification Search ..... 132/277, 132/270, 20–211, 216–218, 200, 276–284
See application file for complete search history.

(56) References Cited

U.S. PATENT DOCUMENTS

| | | | | |
|---|---|---|---|---|
| D292,327 | S | 10/1987 | Kalichman | |
| 5,704,376 | A | 1/1998 | Ogunro | |
| 5,758,672 | A | 6/1998 | Chou | |
| 5,865,190 | A | 2/1999 | Butler | |
| 5,937,868 | A | 8/1999 | Ogunro | |
| 6,019,108 | A | 2/2000 | Chen | |
| 6,263,886 | B1 | 7/2001 | Davis | |
| 6,267,119 | B1 * | 7/2001 | Silva | 132/213 |
| 6,494,214 | B1 * | 12/2002 | Coldicott | 132/213.1 |
| 7,021,317 | B1 * | 4/2006 | Nathaniel | 132/270 |
| 2002/0129828 | A1 * | 9/2002 | Ott | 132/148 |
| 2007/0251540 | A1 * | 11/2007 | Cheung | 132/279 |

* cited by examiner

*Primary Examiner*—Robyn Doan
*Assistant Examiner*—Brianne E O'Neill
(74) *Attorney, Agent, or Firm*—Thomas Frost

(57) ABSTRACT

A hair extension clip having an upper jaw and a lower jaw connected by a hinged member to move between an open and a closed position to grip hair of the customer. Teeth disposed on an inner surface of the upper jaw engage through slots in the lower jaw and in the process separate hair into strands for hair extension treatments. A platform integrally formed with the lower jaw provides a working area to lift hair strands away from the customer's scalp allowing use of multiple modalities of treatment to lessen risk. The upper jaw, the lower jaw and the platform are arcuately shaped to conform to the customer's head.

9 Claims, 5 Drawing Sheets

HAIR EXTENSION CLIP

BACKGROUND OF INVENTION

The present invention relates to a hair extension clip for single strand hair extension service separating multiple sections of hair at a time. The clip is arcuate in shape to conform to the shape of the back of the head, and has opposing jaws connected by a hinged member. The jaws are opened by complimentary finger grips, and hair inserted and separated by teeth formed on the upper jaw for the extension work. A platform formed with the lower jaw provides the working area.

There are a number of different hair extensions techniques, and because of the differences in the way hair extensions are prepared, uniformity of application is a problem. Additionally, some extension techniques, such as gluing or heat fusing, pose potential harm to the customer during the extension application process. Currently many hair clips or styling tools provide rowed teeth to separate hair for work, but either do not provide multiple strands to be securely sectioned off or do not provide an appropriate working platform for ease of use and protection of the scalp of the customer during such extension service as gluing or heat fusing. For example, while United States patent application publication US2002/0129828 discloses a hair clip for extension work for multiple strands, the multiple strands of hair are not securely engaged with complimentary teeth and slots, nor is a working platform provided. Additionally, other clips separate only one section of hair at a time and do not conform to the shape of the head.

It is an object of the invention to provide a hair clip that uniformly separates and secures multiple sections of hair for single strand hair extension service, so as to row off multiple sections of hair instead of one section at a time.

It is a further object of the invention to provide a platform formed with lower jaw of the clip, so that after the strands of hair have been secured and separated, a hair dresser can attach hair extensions to the hair as the hair lies flat across the platform.

It is a further object of the invention to provide a clip that is arcuately shaped so that multiple clips can be placed around the head at one time, so as to allow a hair dresser and assistants to work continuously around a row without having to section off single sections individually.

SUMMARY OF THE INVENTION

The general purpose of the present invention, which will be described subsequently in greater detail, is to provide a new and improved hair extension clip.

To attain this, the present invention comprises a clip having an upper jaw and a lower jaw connected by a resilient hinged member. The upper and lower jaws are arcuately shaped to conform to the shape of the back of the head. Upper and lower finger grip portions are formed on the upper and lower jaws, respectively. A row of teeth is disposed longitudinally on the inner surface of the upper jaw, with complimentary slots formed longitudinally in the lower jaw.

A platform is integrally formed with the lower jaw at a first end and has a lip disposed longitudinally at a second end. A raised upper edge and the lip form a groove therebetween. The raised upper edge of the platform is approximately ½ inch from the plane of the lip to allow the platform to be elevated away from the scalp of the customer. The platform also curved in shape.

The clip is opened by a user squeezing the finger grip portions. Once opened, hair is laid across the lower jaw and the platform. The finger grip portions are released and the elasticity of the hinged member returns the upper jaw to a closed position. When the clip is in the closed position, the teeth of the upper jaw are securely engaged with the slots of the lower jaw. Sections of hair are now disposed within the spacing between the teeth for hair extension service.

Since the sections of hair are positioned flat against the groove of the platform, and not near the scalp, numerous modalities of hair extension techniques can be performed without any harm to the customer's scalp. Additionally, the elevated nature of the platform allows such holding devices as bobby pins and duckbill clips to be attached and firmly hold the sections of hair in place during treatment. The lip at the second end of the platform prevents the holding devices from sliding off during treatment.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
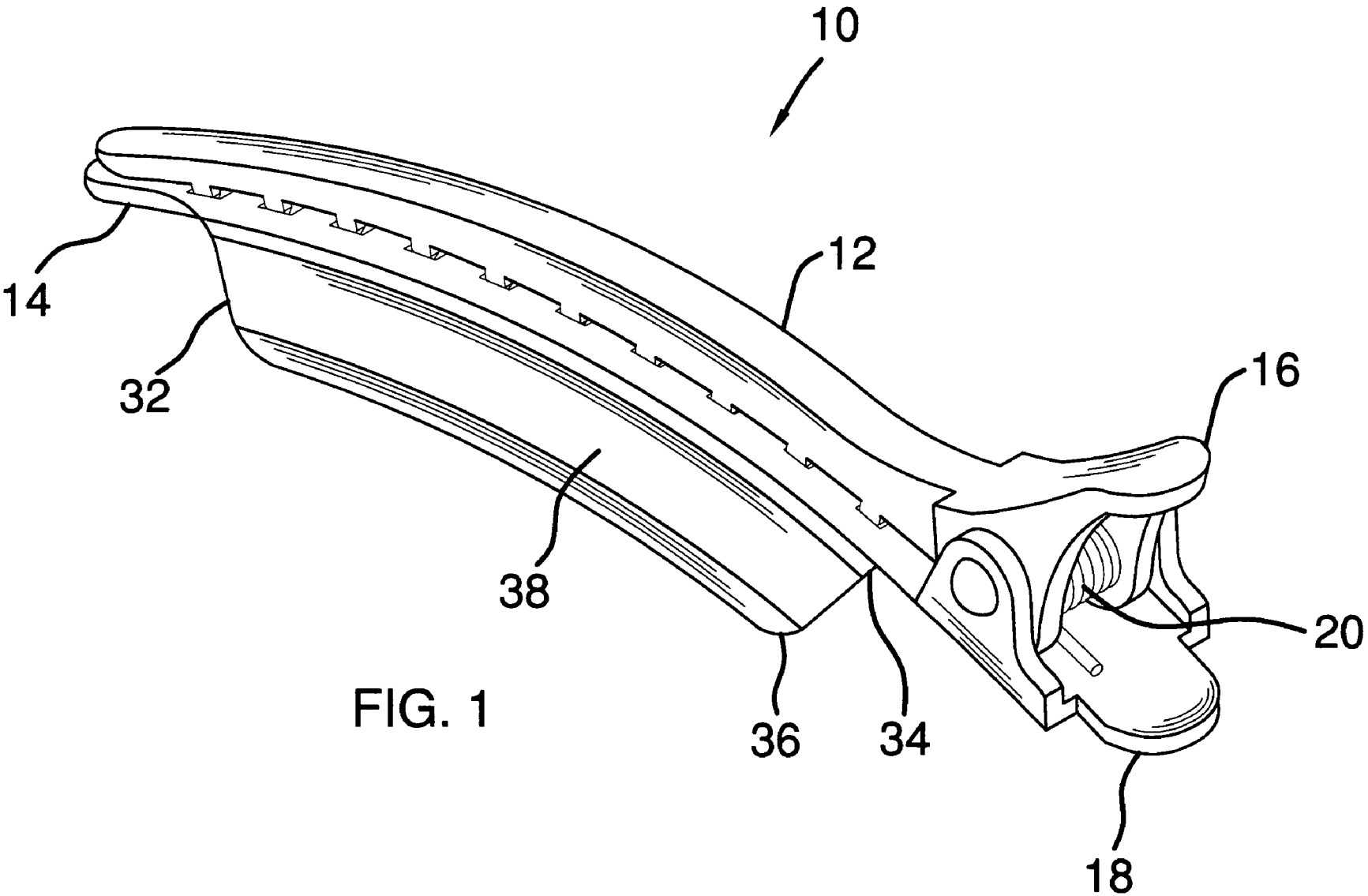
FIG. 1 is a perspective view of the present invention.

Referring first to FIG. 1, therein is shown at 10 a preferred embodiment of the present invention of a hair extension clip. The preferred embodiment has an upper jaw 12 and a lower jaw 14 fixed together by a hinged member 20. The upper jaw 12 and lower jaw 14 are arcuate in shape allowing conformity to the back of the head of a customer of extension services. The hinged member 20 is preferably a torsion spring, and provides resiliency to hold the upper jaw 12 and lower jaw 14 together. An upper finger grip portion 16 is formed on an end of the upper jaw 12, and a lower finger grip portion 18 is formed on the lower jaw 14, with the finger grip portions 16, 18 to work complimentary with each other. A platform 32, having an upper edge 34 and a lip 36 defining a groove 38, is integrally formed on one side of the lower jaw 14. The upper edge 34 and the lip 36 are disposed longitudinally, and the groove 38 extends downwardly from the upper edge 34 to the lip 36.

The clip 10 may be made from any suitable material, such as plastic or metal, or any combination thereof.

Figure 2:
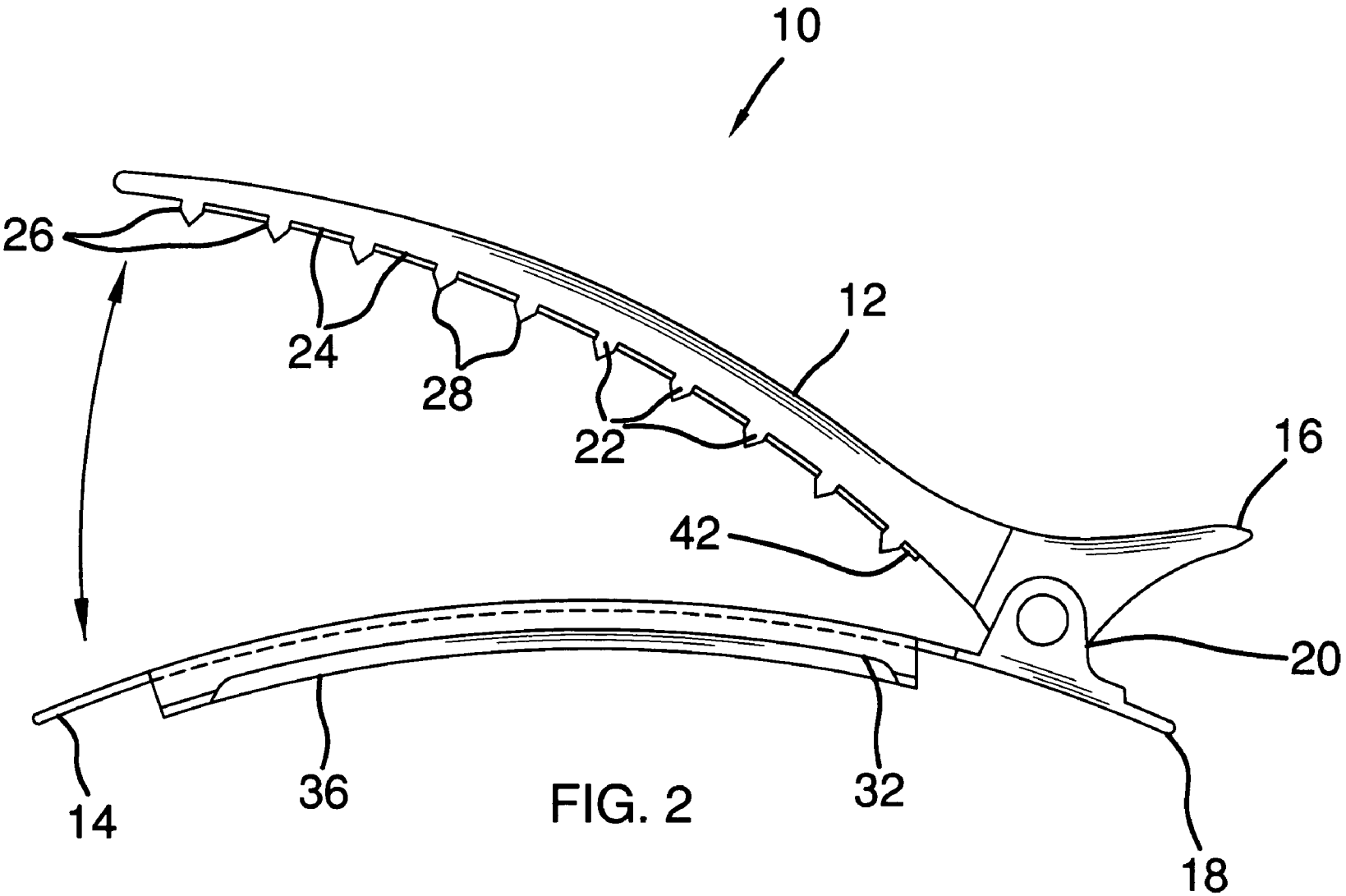
FIG. 2 is a side view of the present invention in an open position.

FIG. 2 illustrates the clip 10 in an open position. A plurality of teeth 22 is longitudinally disposed upon the inner surface of the upper jaw 12. The teeth 22 extend outwardly from the inner surface of the upper jaw 12 and are substantially parallel to one another forming notches 24 therebetween. Each tooth 22 has a shaft portion 26 which extends outward from the upper jaw 12 to a free end 28. Spacing between the teeth 22 defines the amount of hair selected. The ends 28 of the teeth 22 preferably form a point to accommodate hair separation into hair strands. The term "strand" is intended to mean a plurality of individual hairs.

Figure 3:
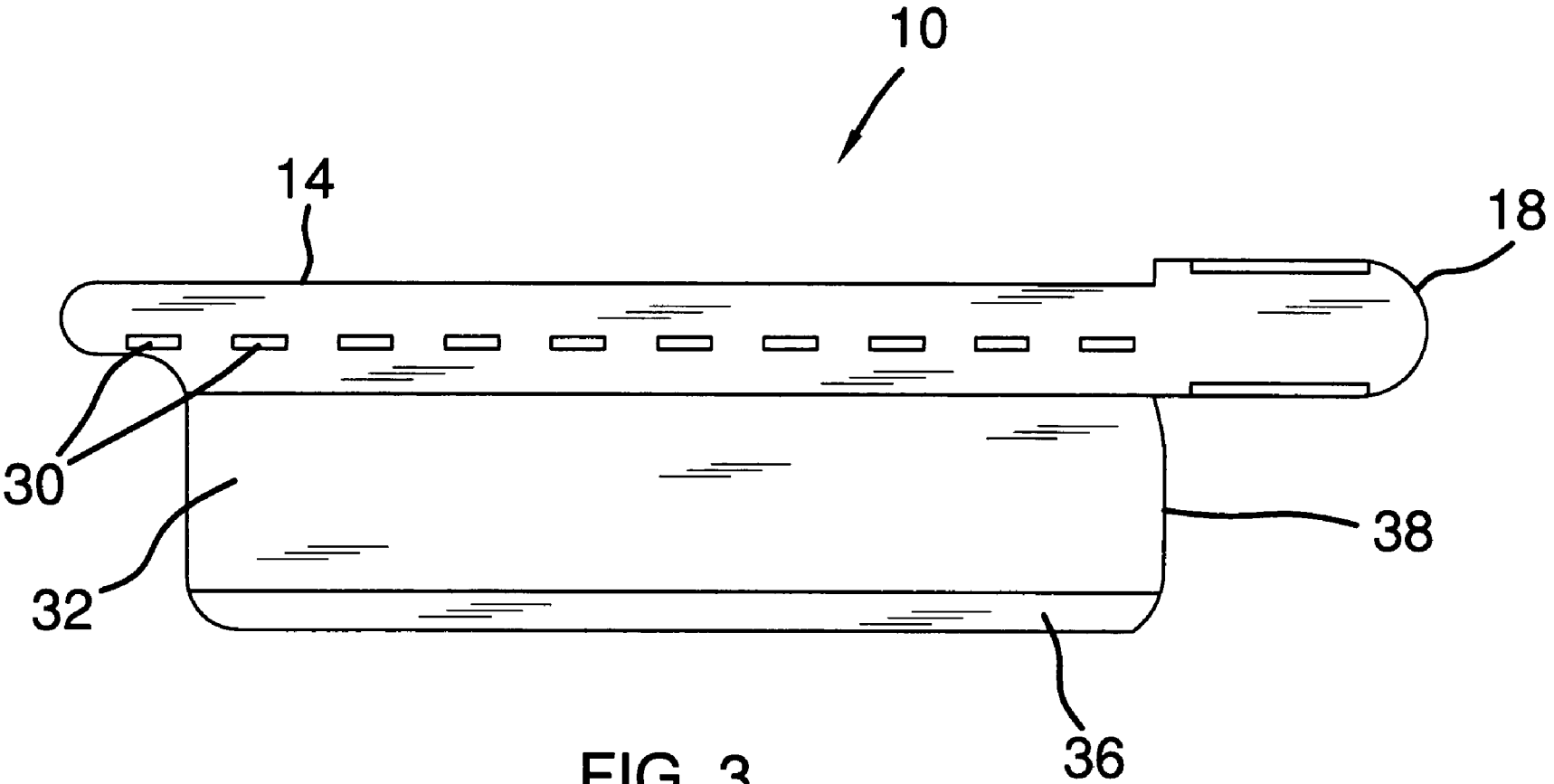
FIG. 3 is a top plan view of the lower jaw of the invention with the upper jaw removed.
Figure 4:
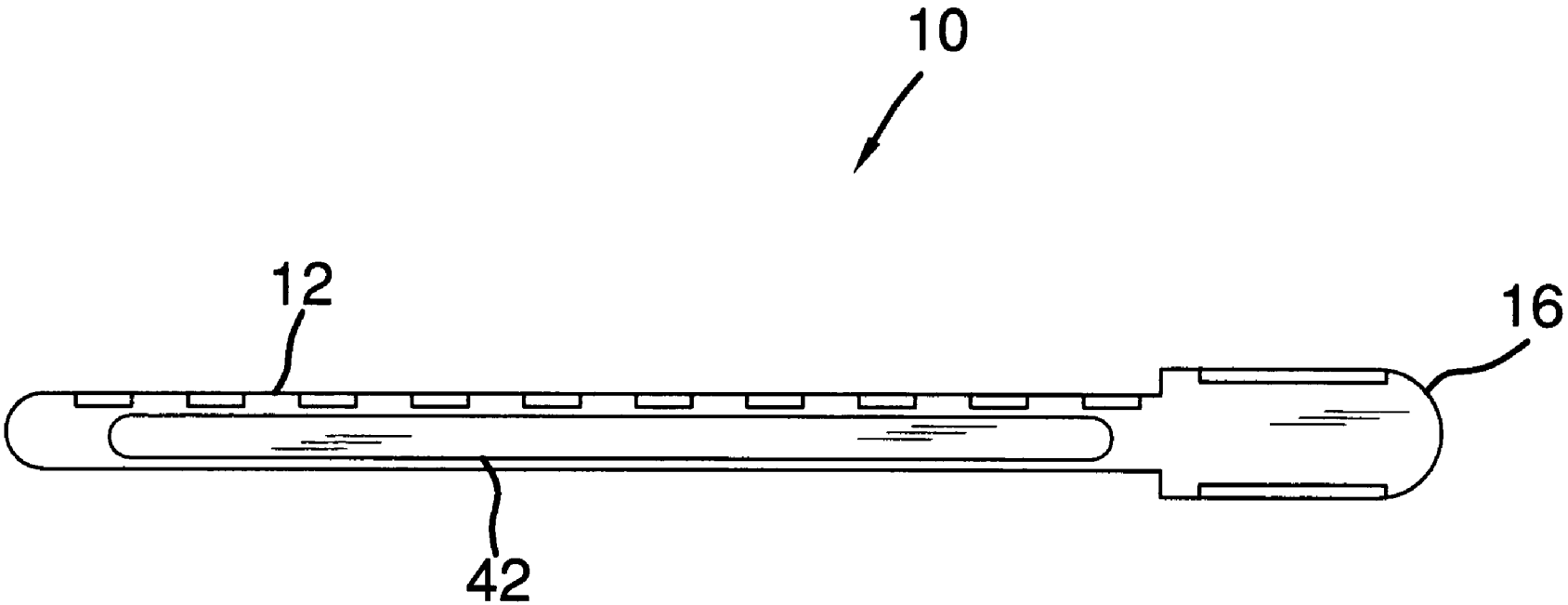
FIG. 4 is a bottom plan view of the upper jaw of the invention with the lower jaw removed.

A plurality of slots 30, as illustrated in FIG. 3, is integrally formed in the lower jaw 14, and is complimentary to the teeth 22 formed on the upper jaw 12. In the closed position of the clip 10 the teeth 22 extend laterally past the lower jaw 14 through the slots 30.

In the preferred embodiment of the clip 10, the upper jaw 12 has a cavity defined longitudinally along its inner surface. Within the cavity a resilient strip 42 is mounted. The strip 42 is preferably made of rubber. When the clip 10 is in the closed position in use the strip 42 presses against hair and contributes to holding the hair in place during treatment.

Figure 5:
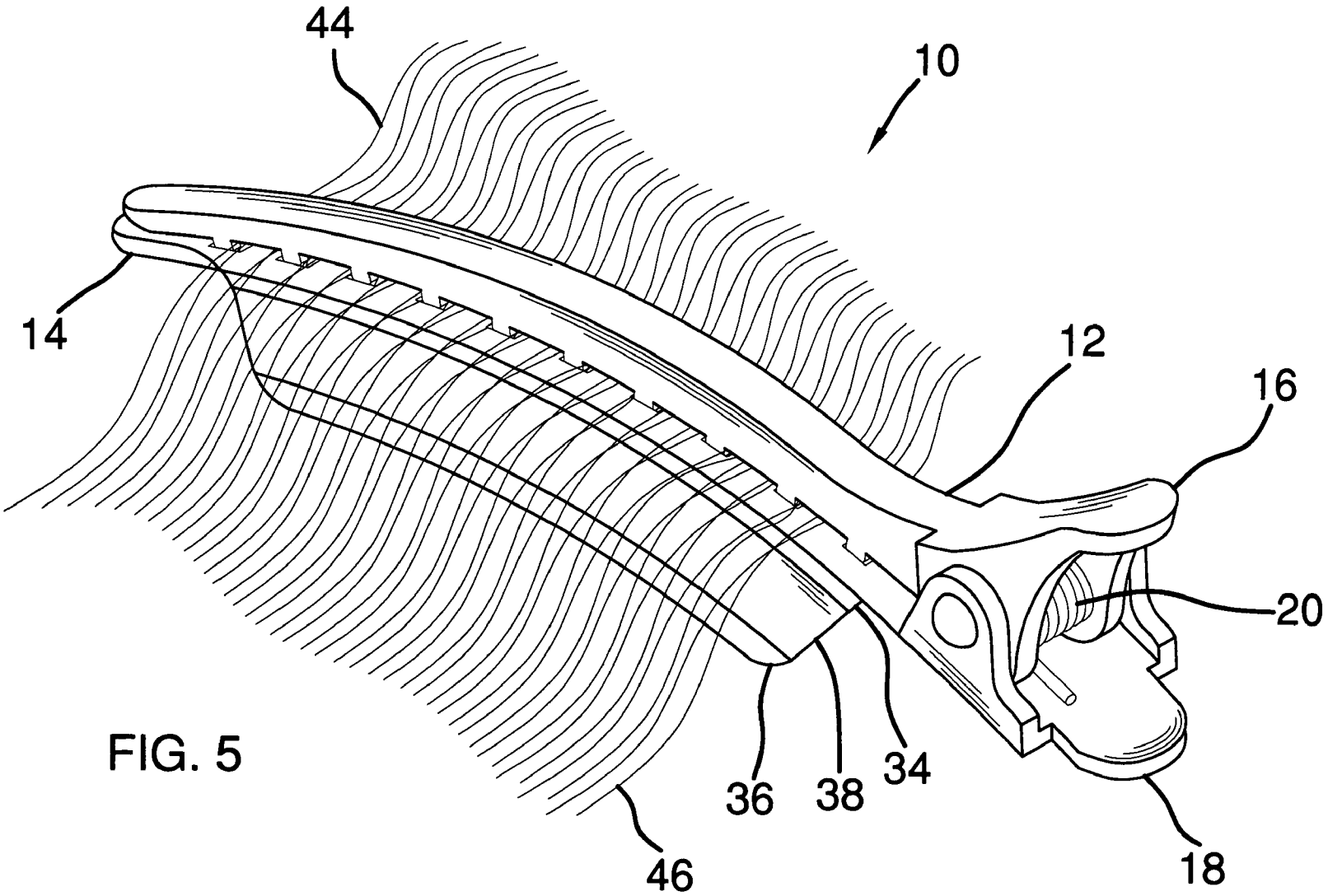
FIG. 5 is a perspective view of the invention in use in a closed position.

FIG. 5 illustrates the clip 10 holding hair for treatment. To use, the clip 10 is opened by depressing the upper finger grip portion 16 to the lower finger grip portion 18, thus disengaging the upper jaw 12 from the lower jaw 14. Hair 44 is laid across the upper surface of the lower jaw 14 and the platform 32. The upper grip portion 16 is released and because of the resiliency of the hinged member 20 the upper jaw 12 moves towards and engages with the lower jaw 14. The clip 10 is in a closed position. The teeth 22 extend laterally past the lower jaw 14 through the slots 30 of the lower jaw 14. The notches 24 between the teeth 22 provide spacing for the hair 44, and allow the hair 44 to be separated into strands 46. The ends 28 of the teeth 22 are preferably pointed to facilitate the separation of hair 44. The mating of the upper jaw 12 and the lower jaw 14 firmly holds the hair 44 and hair strands 46 in place, and allows extensions to be added. The strip 42 presses downward against the hair 44 to snugly hold the hair 44 in position.

The hair strands 46 are positioned within the groove 38 for the hair extension work. Since the hair strands 46 are lifted off of the scalp, and a working area is provided by the platform 32, numerous modalities of extension techniques can be used which would otherwise pose a risk. The platform 32 is inclined and holding devices such as duckbill clips and bobby pins can attach the hair strands 46 firmly to the outer surface of the platform 32 for the hair extension treatment. The lip 36 prevents the holding devices from sliding off of the working area of the platform 32.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A hair extension clip, comprising in combination:

an arcuate upper jaw having a first end, a second end, an outer surface and an inner surface, with an upper finger grip portion integrally formed at the first end, a plurality of teeth substantially parallel to one another and disposed longitudinally on the inner surface;

an arcuate lower jaw having a first end, a second end, an outer surface and an inner surface, with a lower finger grip portion integrally formed at the first end, a plurality of slots formed longitudinally therein, thereby providing complimentary mating with the teeth of the upper jaw, and wherein the teeth extend laterally past the lower jaw when the clip is in a closed position;

a hinged member pivotally connecting the upper jaw and the lower jaw inward of the upper and lower finger grips, allowing the clip to have open and a closed positions; and an arcuate platform integrally formed with the lower jaw having an upper edge and a lip extended longitudinally, the upper edge and the lip defining a groove extended longitudinally along and within the upper edge and the lip, and the groove extending downwardly from the upper edge to the lip.

2. The clip of claim 1, wherein the hinged member is a torsion spring.

3. The clip of claim 1, further comprising a resilient strip mounted within a longitudinal cavity defined within the inner surface of the upper jaw.

4. The clip of claim 3, wherein the strip is formed of rubber.

5. The clip of claim 1, wherein the teeth have ends which are sharpened.

6. A hair extension clip, comprising in combination:

an arcuate upper jaw having a first end, a second end, an outer surface, an inner surface, and a longitudinal cavity defined within the inner surface, with an upper finger grip portion integrally formed at the first end, a plurality of teeth substantially parallel to one another and disposed longitudinally on the inner surface juxtaposed forward of the cavity;

an arcuate lower jaw having a first end, a second end, an outer surface and an inner surface, with a lower finger grip portion integrally formed at the first end, a plurality of slots formed longitudinally therein, thereby providing complimentary mating with the teeth of the upper jaw, and wherein the teeth extend laterally past the lower jaw when the clip is in a closed position;

a hinged member pivotally connecting the upper jaw and the lower jaw inward of the upper and lower finger grip portions, allowing the clip to have open and a closed positions;

an arcuate platform integrally formed with the lower jaw having an upper edge and a lip extended longitudinally, the upper edge and the lip defining a groove extended longitudinally along and within the upper edge and the lip, and the groove extending downwardly from the upper edge to the lip; and a strip of resilient material mounted within the cavity defined within the inner surface of the upper jaw.

7. The clip of claim 6, wherein the hinged member is a torsion spring.

8. The clip of claim 6, wherein the strip is formed of rubber.

9. The clip of claim 6, wherein the teeth have ends which are sharpened.

* * * * *